US008004254B2

(12) United States Patent
Agari et al.

(10) Patent No.: US 8,004,254 B2
(45) Date of Patent: Aug. 23, 2011

(54) POWER SUPPLY CIRCUIT

(75) Inventors: Hideki Agari, Ikeda (JP); Kohiji Yoshii, Sanda (JP)

(73) Assignee: Ricoh Company, Ltd., Tokyo (JP)

( * ) Notice: Subject to any disclaimer, the term of this patent is extended or adjusted under 35 U.S.C. 154(b) by 361 days.

(21) Appl. No.: 12/388,144

(22) Filed: Feb. 18, 2009

(65) Prior Publication Data

US 2009/0206813 A1 Aug. 20, 2009

(30) Foreign Application Priority Data

Feb. 19, 2008 (JP) ..... 2008-037024

(51) Int. Cl.
*G05F 1/59* (2006.01)
*G05F 1/56* (2006.01)

(52) U.S. Cl. ..... 323/266; 323/270; 323/901

(58) Field of Classification Search ..... 323/266, 323/268, 270, 273, 274, 275, 901; 363/49
See application file for complete search history.

(56) References Cited

U.S. PATENT DOCUMENTS

| | | | | |
|---|---|---|---|---|
| 5,132,893 | A * | 7/1992 | Klein et al. | 363/49 |
| 5,610,450 | A | 3/1997 | Saeki et al. | |
| 6,713,992 | B2 * | 3/2004 | Matsuo et al. | 323/266 |
| 6,856,525 | B2 * | 2/2005 | Wallis | 363/59 |
| 7,199,567 | B2 * | 4/2007 | Eberlein | 323/276 |
| 7,486,064 | B2 * | 2/2009 | Sasaki et al. | 323/299 |
| 2006/0267567 | A1 | 11/2006 | Tanaka | |

FOREIGN PATENT DOCUMENTS

| | | |
|---|---|---|
| CN | 1874104 A | 12/2006 |
| JP | 8-140286 | 5/1996 |
| JP | 2003-180073 | 6/2003 |
| JP | 2005-168298 | 6/2005 |
| JP | 2006-277760 | 10/2006 |
| KR | 10-0797874 | 1/2008 |

* cited by examiner

*Primary Examiner* — Gary L Laxton
(74) *Attorney, Agent, or Firm* — Cooper & Dunham LLP

(57) ABSTRACT

A power supply circuit includes a first voltage regulator, a second voltage regulator, and a voltage comparator. The first voltage regulator is connected to a direct current power supply, and regulates a direct current supply voltage down to a first voltage level to output a first voltage at a first output terminal. The second voltage regulator is connected to the first voltage regulator, and regulates the first output voltage down to a constant, second voltage level to output a second voltage at a second output terminal. The voltage comparator is connected to the first and second voltage regulators, compares the first output voltage against a given threshold level greater than the second voltage level, and deactivates the second voltage regulator until the first output voltage exceeds the given threshold level upon startup of the power supply circuit.

4 Claims, 3 Drawing Sheets

POWER SUPPLY CIRCUIT

BACKGROUND OF THE INVENTION

1. Technical Field

The present invention relates to a power supply circuit for electronic devices, and more particularly, to a power supply circuit that supplies power to load circuitry operating at a supply voltage of 1 volt or below.

2. Discussion of the Background

With the growing concern for environmental protection and energy conservation, there is increasing demand for electrical appliances operating at low power. Thus, power supply circuits, particularly those used in battery-powered devices, are required to be more energy-efficient to meet low-power and low-voltage requirements of such low-power electronic devices.

FIG. 1 is a diagram illustrating an example of a conventional power supply circuit 100 used in a low-power electronic device.

As shown in FIG. 1, the power supply circuit 201 includes a first voltage regulator 210 and a second voltage regulator 220, and has an input terminal Vdd and a ground terminal Vss connected to positive and negative terminals of a battery Bat and an output terminal OUT connected to a load circuit, not shown.

In the power supply circuit 201, the first voltage regulator 210 is a step-down switching regulator and the second voltage regulator 220 is a series regulator. The second voltage regulator 220 includes a P-channel metal-oxide-semiconductor (PMOS) transistor or output transistor M201, first and second resistors R201 and R202, an error amplifier 221, and a reference voltage generator 222.

During operation, the power supply circuit 201 regulates a battery voltage Vbat input from the battery Bat to generate a constant supply voltage for output to the load circuit, wherein the first voltage regulator 210 steps the battery voltage down to a given first level, followed by the second voltage regulator 220 linearly regulating the stepped-down voltage to a given second level.

Unlike other common power supplies using a combination of first and second voltage regulators, the power supply circuit 201 draws power to drive the reference voltage generator 222 directly from the battery Bat and not from the first voltage regulator 210. This eliminates the need for setting the output voltage of the first voltage regulator significantly higher than that of the second voltage regulator, which is typical of most conventional dual-regulator designs where the reference voltage generator consumes relatively high power. Thus, the power supply circuit 201 features enhanced efficiency in terms of power consumption in the secondary voltage regulation.

However, the power supply circuit described above may not be used with modern low-power electronic devices operating at extremely low voltages of 1 volt or below, where a PMOS-based output transistor, with an applied gate voltage not falling below 0 volt, may not properly turn on to output sufficient current to the load circuit.

One approach to improving performance of the conventional circuit is to lower the on-resistance of the PMOS transistor, for example, by increasing the aspect ratio or reducing the threshold voltage. However, such an approach could be costly or inefficient, since increasing the aspect ratio of a PMOS transistor requires increased chip area and additional manufacturing costs, and reducing the threshold voltage of a transistor gate induces significant current leak during shutoff, resulting in increased energy consumption.

Another approach to overcoming the limitation of the PMOS-based conventional circuit is to use an N-channel MOS (NMOS) transistor as the output device in the second voltage regulator. Using an NMOS device provides proper turn-on of the output transistor, leading to improved performance of the power supply circuit. However, even such an approach is insufficient as it can compromise stability of the power supply due to overshoot of the output voltage during start-up.

Thus, what is needed is an energy-efficient, stable power supply circuit that can supply power to low-power electronic devices that operate at extremely low voltages of 1 volt or below.

BRIEF SUMMARY

This disclosure describes a novel power supply circuit that supplies power to load circuitry operating at a low supply voltage.

In one aspect of the disclosure, the novel power supply circuit includes a first voltage regulator, a second voltage regulator, and a voltage comparator. The first voltage regulator is connected to a direct current power supply, and regulates a direct current supply voltage down to a first voltage level to output a first voltage at a first output terminal. The second voltage regulator is connected to the first voltage regulator, and regulates the first output voltage down to a constant, second voltage level to output a second voltage at a second output terminal. The voltage comparator is connected to the first and second voltage regulators, compares the first output voltage against a given threshold level greater than the second voltage level, and deactivates the second voltage regulator until the first output voltage exceeds the given threshold level upon startup of the power supply circuit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
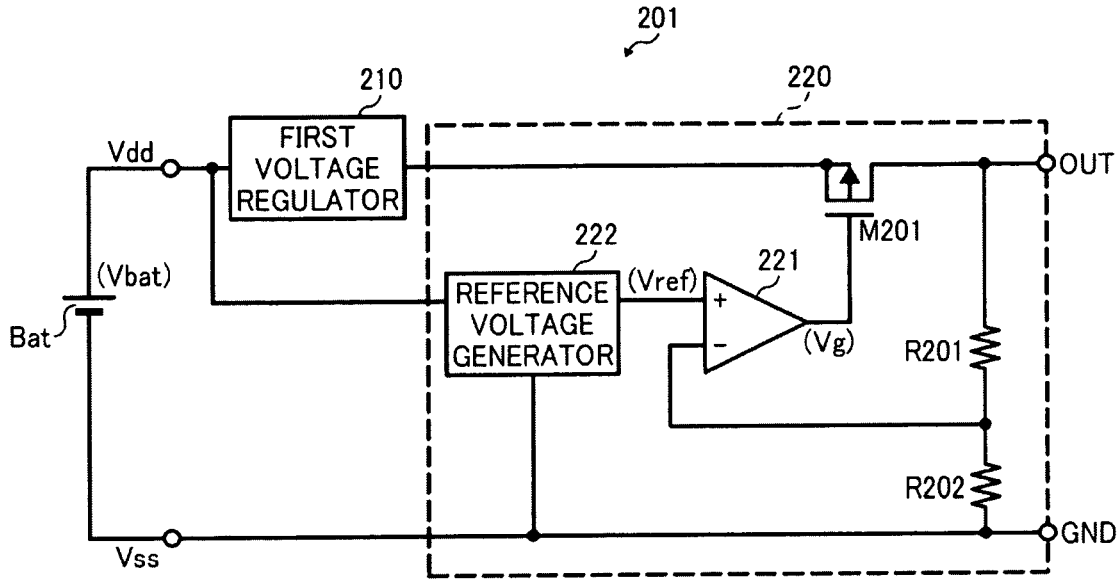
FIG. 1 BACKGROUND ART
FIG. 1 is a diagram illustrating an example of a conventional power supply circuit.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, examples and exemplary embodiments of this disclosure are described.

Figure 2:
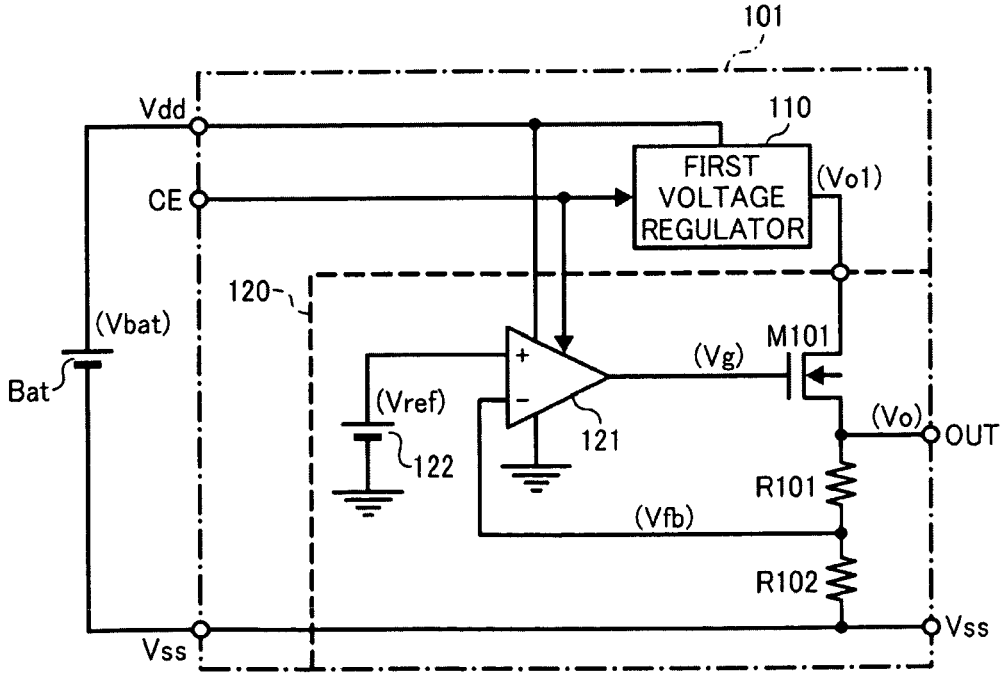
FIG. 2 is a diagram illustrating an example of a power supply circuit using an NMOS device.

FIG. 2 is a diagram illustrating an example of a power supply circuit 101 known in the art that employs an NMOS device.

As shown in FIG. 2, the power supply circuit 101 includes a first voltage regulator 110 and a second voltage regulator 120, as well as an input terminal Vdd connected to a battery Bat, a ground terminal Vss connected to a ground potential, an output terminal OUT connected to the load circuit, and an enable terminal CE connected to a suitable controller, not shown.

In the power supply circuit 101, the first voltage regulator 110 is a step-down switching regulator with an input terminal connected to the terminal Vdd, an output terminal connected to the second voltage regulator 120, and an enable input terminal connected to the terminal CE.

The second voltage regulator 120 is a series regulator with an input terminal connected to the output terminal of the first voltage regulator 110, an output terminal connected to the terminal OUT, and an enable input terminal connected to the terminal CE. The second voltage regulator 120 includes an output transistor M101, an error amplifier 121, a reference voltage generator 122, and first and second resistors R101 and R102. The output transistor M101 is an N-channel metal-oxide-semiconductor (NMOS) transistor, having a drain connected to the output terminal of the first voltage regulator 110, a source connected to the output terminal OUT, and a gate connected to an output of the error amplifier 121. The error amplifier 121 has a non-inverting input connected to the reference voltage generator 122, an inverting input connected to a node between the resistors R101 and R102, and an enable input connected to the terminal CE.

During operation, the power supply circuit 101 regulates a battery voltage Vbat input from the battery Bat to generate a constant supply voltage Vo for output to the load circuit.

Specifically, the first voltage regulator 110 primarily steps the input voltage Vbat down to a first voltage level V101 to output an intermediate output voltage Vo1 to the second voltage regulator 120. Receiving the intermediate output voltage Vo1 at its input terminal, the second voltage regulator 120 linearly regulates the voltage Vo1 down to a second voltage level V102 to output the final output voltage Vo at the power supply output terminal OUT.

In the second voltage regulator 120, the resistors R101 and R102 generate a feedback signal Vfb by dividing the output voltage Vo, while the reference voltage generator 122 generates a given reference voltage Vref. The error amplifier 121 compares the voltages Vfb and Vref to output a gate control voltage Vg to the gate of the output transistor M101. According to the control voltage Vg, the output transistor M101 outputs the voltage Vo to the output terminal OUT.

In such a configuration, the first voltage level V101 is designed to be only slightly higher than the second voltage level V102, with a minimal difference between V101 and V102 that still allows for voltage regulation by the output transistor M101. This reduces power dissipation across the output transistor M101 and enhances energy efficiency of the power supply circuit 101.

Further, the error amplifier 121 draws power from the battery Bat, and not from the first voltage regulator 110 as is common with a conventional dual-regulator power supply circuit. Powering the error amplifier 121 by the high battery voltage Vbat instead of the low intermediate output voltage Vo1 ensures proper turn-on of the output transistor M101, thereby increasing stability of the power supply circuit 101.

In the power supply circuit 101, step-down voltage regulation and linear voltage regulation are both activated by a binary enable signal CE input from the enable terminal CE to the enable input terminal of the first voltage regulator 110 and to the enable input of the error amplifier 121, respectively. With the enable signal CE remaining low, the first and second voltage regulators 110 and 120 both remain inactive and output no voltage at their output terminals. When the enable signal CE goes high, the first and second voltage regulators 110 and 120 simultaneously start voltage regulation.

Figure 3:
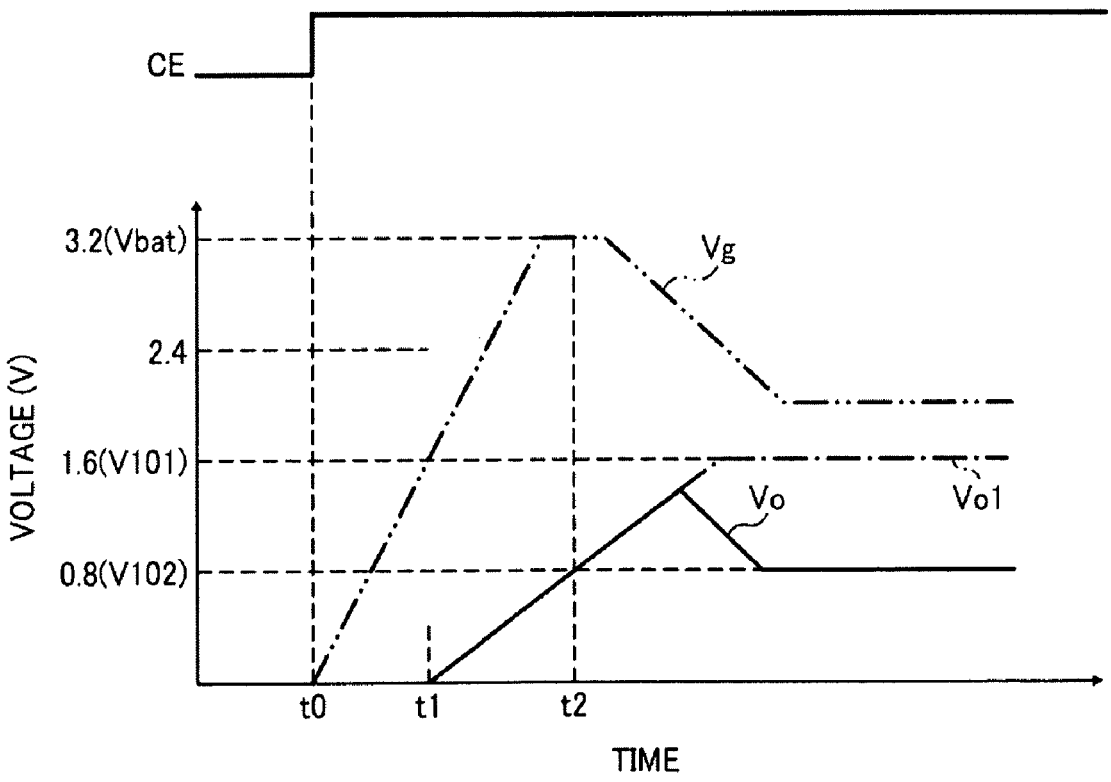
FIG. 3 is a timing diagram showing exemplary waveforms of various signals in the power supply circuit of FIG. 2 during startup.

FIG. 3 is a timing diagram showing exemplary waveforms of Vo, Vo1, and Vg along with CE in the power supply circuit 101 during startup, with the battery voltage Vbat set at 3.2 V, the first voltage level V101 at 1.6 V, and the second voltage level V102 at 0.8 V.

As shown in FIG. 3, when the first enable signal CE goes high at time t0 to simultaneously activate the first voltage regulator 110 and the second voltage regulator 120, the gate control voltage Vg starts to rise immediately upon activation, while the intermediate output voltage Vo1 starts to rise with a short delay after activation.

The gate control voltage Vg continues to rise toward a maximum of Vbat as long as the feedback voltage Vfb is below the reference voltage Vref, or the intermediate output voltage Vo1 is below the second voltage level V102. Thus, the output transistor M101, having a threshold of approximately 1.2 V or so, turns on before the intermediate output voltage Vo1 starts to rise at time t1. With the output transistor M101 fully turned on, the transistor output voltage Vo starts to rise at time t1 concomitantly with the intermediate output voltage Vo1.

At time t2, the output voltage Vo reaches the second voltage level V102 so that the feedback voltage Vfb matches the reference voltage Vref, while the gate control voltage Vg is at its maximum voltage to maintain the output transistor M101 fully turned on. As a result, the output voltage Vo continues to rise for a certain period of time following time t2 and approaches the first voltage level V101 beyond the desired voltage level V102, hence causing an overshoot at the startup of the power supply circuit 101.

Shortly after time t2, the gate control voltage Vg starts to decline as the output voltage Vo exceeds the voltage level V102, reducing a voltage difference between Vg and Vo, or gate-to-source voltage of the output transistor M101. The output voltage Vo peaks and starts to decline when the gate-to-source voltage is reduced to a given value. When the output voltage Vo reaches the second voltage level V102, the operation of the error amplifier 121 becomes stable so as to maintain the voltage Vo at the constant level V102.

Thus, the power supply circuit 110 depicted in FIG. 2 has a drawback in that simultaneously activating the first and second voltage regulators 110 and 120 results in the intermediate output voltage Vo1 starting to rise only after the gate control voltage Vg has risen beyond the threshold voltage of the output transistor M101, leading to delayed response of the second voltage regulator 120 and overshoot of the output voltage Vo at startup of the power supply circuit 110.

Figure 4:
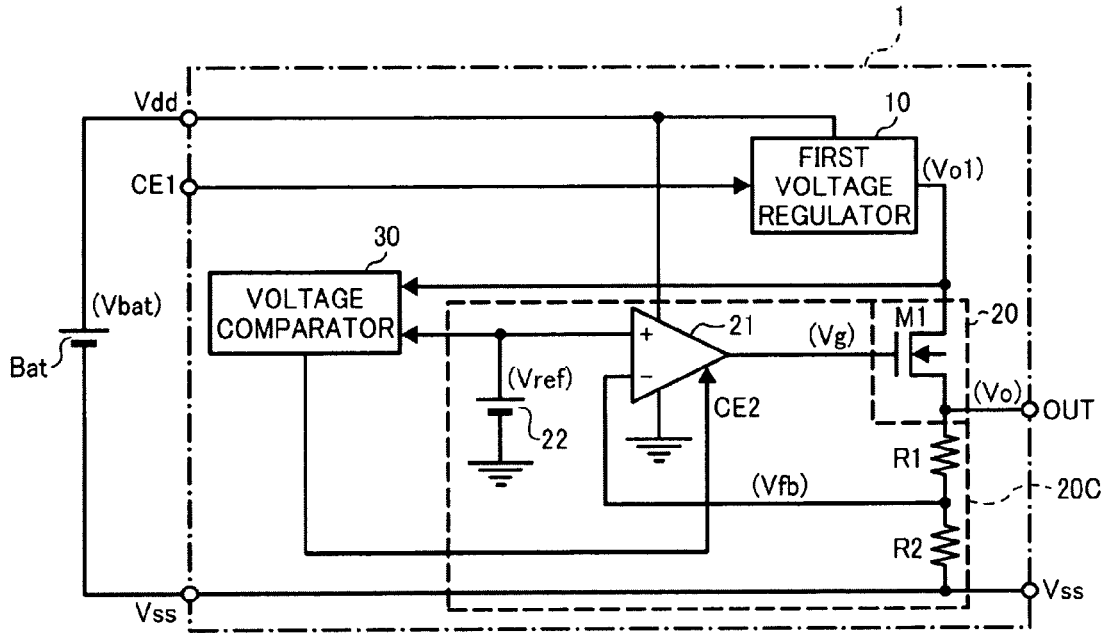
FIG. 4 is a diagram illustrating an example of a power supply circuit according to this patent specification.

FIG. 4 is a diagram illustrating an example of a power supply circuit 1 according to this patent specification.

As shown in FIG. 4, the power supply circuit 1 includes a first voltage regulator 10, a second voltage regulator 20, and a voltage comparator 30, all of which are integrated into a single integrated circuit (IC) having an input terminal Vdd, a ground terminal Vss, an output terminal OUT, and a first enable terminal CE1. The terminal Vdd and Vss are connected to positive and negative terminals, respectively, of a direct current (DC) source or battery Bat, and the terminals OUT and Vss are connected to terminals of a load circuit, not shown.

In the power supply circuit 1, the first voltage regulator 10 is any appropriate voltage regulator, preferably a step-down switching regulator in terms of power efficiency, and has an input terminal connected to the terminal Vdd, an output terminal connected to the second voltage regulator 20 and the voltage comparator 30, and an enable input terminal connected to the terminal CE1.

The second voltage regulator 20 is a series regulator with an input terminal connected to the output terminal of the first voltage regulator 10, an output terminal connected to the terminal OUT, and another set of input and output terminals connected to the voltage comparator 30. The second voltage regulator 20 includes an output transistor M1 and a control circuit 20C formed of an error amplifier 21, a reference voltage generator 22, and first and second resistors R1 and R2. The output transistor M1 is an N-channel metal-oxide-semiconductor (NMOS) transistor, having a drain connected to the output terminal of the first voltage regulator 10, a source connected to the output terminal OUT, and a gate connected to an output of the error amplifier 21. The error amplifier 21 has a non-inverting input connected to the reference voltage generator 22, an inverting input connected to a node between the resistors R1 and R2, and an enable input connected to the voltage comparator 30.

The voltage comparator 30 has one input connected to the output terminal of the first voltage regulator 10, another input connected to the reference voltage generator 22, and an output connected to the enable input of the error amplifier 21.

During operation, the power supply circuit 1 operates in a manner similar to that of the circuit 101 depicted in FIG. 2.

Specifically, the first voltage regulator 10 primarily steps the input voltage Vbat down to a first voltage level V1 to output an intermediate output voltage Vo1 to the second voltage regulator 20. Receiving the intermediate output voltage Vo1 at its input terminal, the second voltage regulator 20 linearly regulates the voltage Vo1 down to a second voltage level V2 to output the final output voltage Vo at the power supply output terminal OUT.

In the second voltage regulator 20, the resistors R1 and R2 generate a feedback signal Vfb by dividing the output voltage Vo, while the reference voltage generator 22 generates a given reference voltage Vref. The error amplifier 21 compares the voltages Vfb and Vref to output a gate control voltage Vg to the gate of the output transistor M1. According to the control voltage Vg, the output transistor M1 outputs the voltage Vo to the output terminal OUT.

Under stable conditions, the power supply circuit 1 maintains the intermediate output voltage Vo1 at the first voltage level V1 and the final output voltage Vo at the second voltage level V2. As in the case of the circuit of FIG. 2, the first voltage level V1 is designed to be only slightly higher than the second voltage level V2 with a minimal difference between V1 and V2 that still allows for voltage regulation by the output transistor M1, and the error amplifier 21 draws power from the battery Bat and not from the first voltage regulator 10. With the reduced difference between V1 and V2 and the battery-powered error amplifier 21, the power supply circuit 1 provides a low power consumption circuit without sacrificing stable performance as described above with reference to FIG. 2.

In the power supply circuit 1, step-down voltage regulation is activated by a binary first enable signal CE1 input from the first enable terminal CE1 to the enable input terminal of the first voltage regulator 10. With the enable signal CE1 remaining low, the first voltage regulator 10 remains inactive and outputs no voltage at its output terminal. When the enable signal CE1 goes high, the first voltage regulator 10 starts voltage regulation to output the intermediate output voltage Vo1 to the second voltage generator 20 at the first voltage level V1.

On the other hand, linear voltage regulation is activated by a binary second enable signal CE2 input from the voltage comparator 30 to the enable input of the error amplifier 21. With the enable signal CE2 remaining low, the error amplifier 21 remains inactive and maintains the control voltage Vg at a low level, resulting in the second voltage regulator 20 outputting no voltage at the output terminal OUT. When the enable signal CE2 goes high, the error amplifier 21 starts error amplification to adjust the control voltage Vg, so that the output transistor M1 outputs the voltage Vo to the output terminal OUT at the second voltage level V2.

To provide the second enable signal CE2, the voltage comparator 30 compares the intermediate output voltage Vo1 with a given threshold level Vx slightly higher than the second voltage level V2 by, e.g., approximately 50 millivolts. In response to the voltage Vo1 reaching the threshold level Vx, the voltage comparator 30 outputs the second enable signal CE2 to enable the error amplifier 21.

Figure 5:
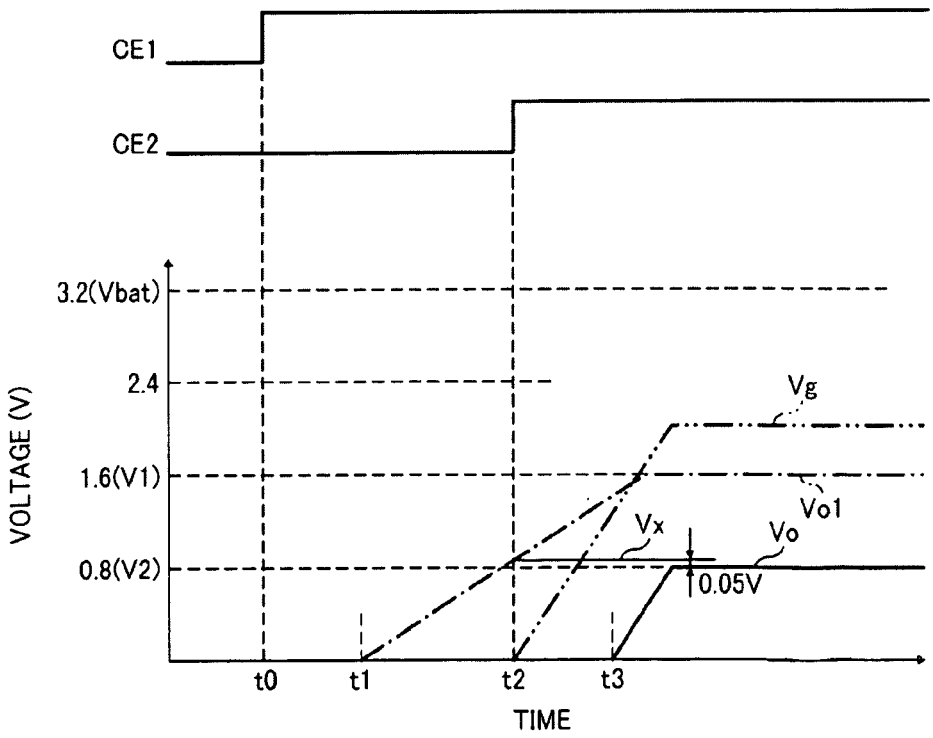
FIG. 5 is a timing diagram showing exemplary waveforms of various signals in the power supply circuit of FIG. 4 during startup.

FIG. 5 is a timing diagram showing exemplary waveforms of Vo, Vo1, and Vg along with CE1 and CE2 in the power supply circuit 1 during startup, with the battery voltage Vbat set at 3.2 V, the first voltage level V1 at 1.6 V, and the second voltage level V2 at 0.8 V.

As shown in FIG. 5, when the first enable signal CE1 goes high at time t0 to activate the first voltage regulator 10, the intermediate output voltage Vo1 starts to rise at time t1 with a short delay after activation. In contrast to the timing diagram of FIG. 3, with the second enable signal CE2 remaining low, the gate control voltage Vg remains at its low level immediately after activation. This results in the output transistor M1 remaining off at time t1, so that the output voltage Vo does not rise concomitantly with the intermediate output voltage Vo1.

At time t2, the intermediate output voltage Vo1 reaches a threshold level Vx approximately 0.05 V higher than the second voltage level V2. Correspondingly, the voltage comparator output, or enable signal CE2, goes high to enable the error amplifier 21 to output the gate control voltage Vg.

At time t3, the gate control voltage Vg reaches a threshold voltage of the output transistor M1. As a result, the output transistor M1 turns on so that its output voltage Vo starts to rise. When the output voltage Vo reaches the second voltage level V2, the operation of the error amplifier 21 becomes stable so as to maintain the voltage Vo at the desired constant level V2.

It is to be noted that the second enable signal CE2, holding the error amplifier 21 inactive until the intermediate output voltage Vo1 exceeds the threshold level Vx slightly higher than the second voltage level V2, prevents the gate control voltage Vg from going too high, thereby preventing overshoot of the output voltage Vo during startup of the power supply circuit 1.

Numerous additional modifications and variations are possible in light of the above teachings. For example, although the error amplifier 21 is powered by the battery voltage in the embodiment described herein, any voltage source that can provide a voltage higher than the first voltage level V1 and sufficient to turn on the output transistor M1 may be used to drive the error amplifier 21. It is therefore to be understood that, within the scope of the appended claims, the disclosure of this patent specification may be practiced otherwise than as specifically described herein.

This patent specification is based on Japanese patent application No. JP-A-2008-037024 filed on Feb. 19, 2008 in the Japanese Patent Office, the entire contents of which are hereby incorporated by reference herein.

What is claimed is:

1. A power supply circuit comprising:

a first voltage regulator, connected to a direct current power supply, to regulate a direct current supply voltage down to a first voltage level to output a first voltage at a first output terminal;

a second voltage regulator, connected to the first voltage regulator, to regulate the first output voltage down to a constant, second voltage level to output a second voltage at a second output terminal; and a voltage comparator, connected to the first and second voltage regulators, to compare the first output voltage against a given threshold level greater than the second voltage level, and deactivate the second voltage regulator until the first output voltage exceeds the given threshold level upon startup of the power supply circuit.

2. The power supply circuit according to claim 1, wherein the second voltage regulator includes:

an output transistor being an N-channel metal-oxide-semiconductor transistor having one electrode connected to the first output terminal and another electrode connected to the second output terminal; and a control circuit, driven by a supply voltage greater than the first voltage level, to control the output transistor to adjust the second output voltage to the second voltage level, the voltage comparator causing the control circuit to turn off the output transistor as long as the first output voltage remains below the given threshold level.

3. The power supply circuit according to claim 1, wherein the first voltage regulator is a switching regulator and the second voltage regulator is a series regulator.

4. The power supply circuit according to claim 1, wherein the second voltage level is below 1 volt.

* * * * *

UNITED STATES PATENT AND TRADEMARK OFFICE

CERTIFICATE OF CORRECTION

PATENT NO. : 8,004,254 B2
APPLICATION NO. : 12/388144
DATED : August 23, 2011
INVENTOR(S) : Hideki Agari and Kohji Yoshii It is certified that error appears in the above-identified patent and that said Letters Patent is hereby corrected as shown below:

Replace the Inventor section on the cover page of the patent, with the following:

-- (75) Inventor: Hideki Agari, Ikeda (JP); Kohji Yoshii, Sanda (JP) --

Signed and Sealed this
First Day of November, 2011

David J. Kappos

David J. Kappos
*Director of the United States Patent and Trademark Office*